US008475008B2

(12) United States Patent
Peters

(10) Patent No.: US 8,475,008 B2
(45) Date of Patent: Jul. 2, 2013

(54) INTEGRATED SLEEVE AND CAP UNIT OPTICALLY SCREENS LIGHT SOURCE AND INTERCEPTS LIGHT RAYS IN A LIGHTING UNIT WITH A REFLECTOR

(75) Inventor: Ralph Hubert Peters, Eindhoven (NL)

(73) Assignee: Koninklijke Philips Electronics N.V., Eindhover (NL)

( * ) Notice: Subject to any disclaimer, the term of this patent is extended or adjusted under 35 U.S.C. 154(b) by 1694 days.

(21) Appl. No.: 10/510,310

(22) PCT Filed: Apr. 11, 2003

(86) PCT No.: PCT/IB03/01486

§ 371 (c)(1),
(2), (4) Date: Oct. 6, 2004

(87) PCT Pub. No.: WO03/087663

PCT Pub. Date: Oct. 23, 2003

(65) Prior Publication Data

US 2005/0117350 A1 Jun. 2, 2005

(30) Foreign Application Priority Data

Apr. 12, 2002 (EP) ..... 02076444

(51) Int. Cl.
*F21V 7/00* (2006.01)

(52) U.S. Cl.
USPC ..... 362/303; 362/351

(58) Field of Classification Search
USPC ..... 362/303, 351
See application file for complete search history.

(56) References Cited

U.S. PATENT DOCUMENTS 5,140,220 A * 8/1992 Hasegawa ..... 362/329
5,838,104 A * 11/1998 Rutan et al. ..... 313/560
6,382,816 B1 * 5/2002 Zhao et al. ..... 362/310

FOREIGN PATENT DOCUMENTS

| | | |
|---|---|---|
| DE | 3341025 | 5/1985 |
| DE | 29809619 | 7/1998 |
| EP | 0336478 | 10/1989 |
| GB | 1395313 | 5/1975 |

* cited by examiner

*Primary Examiner* — William Carter

(57) ABSTRACT

The invention relates to a lighting unit (1) having a concave reflector (2) with an axis of symmetry (3) and a light emission window 21) bounded by a circumferential edge (20) transverse to the axis, an elongate light source (30) extending substantially along the axis of symmetry (3), which light source (30) is accommodated in a holder (4) opposite the light emission window (21), and an axially positioned cap (5), which cap partly surrounds the light source (30) and forms an optical screening means to intercept unreflected light rays. According to the invention, the cap (5) forms part of a sleeve (60) surrounding the light source (30).

12 Claims, 3 Drawing Sheets

Figure 1:
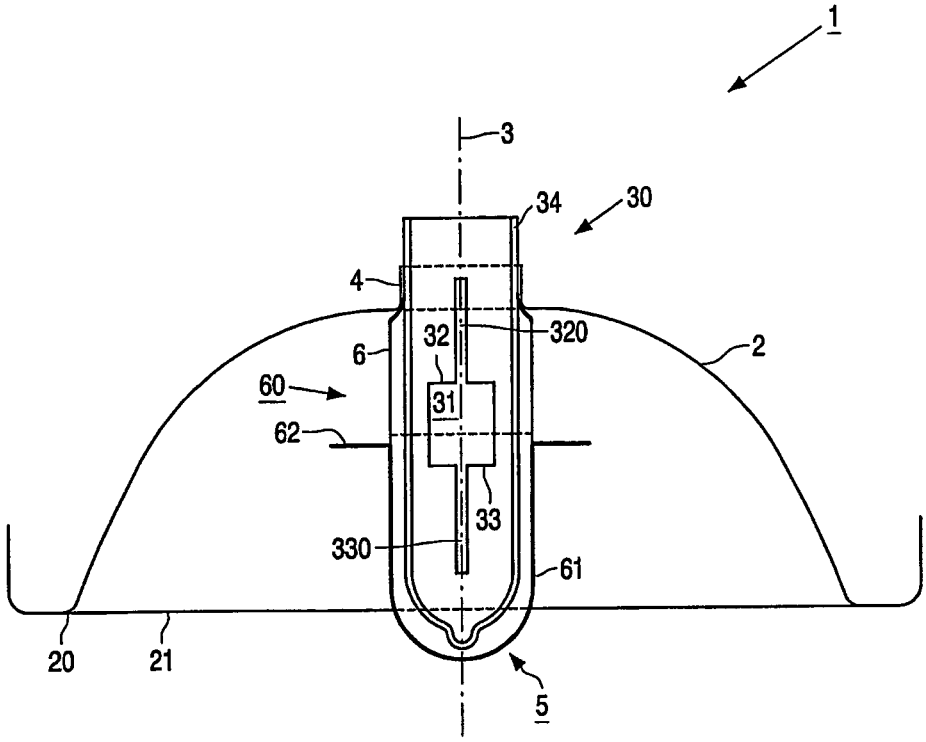

INTEGRATED SLEEVE AND CAP UNIT OPTICALLY SCREENS LIGHT SOURCE AND INTERCEPTS LIGHT RAYS IN A LIGHTING UNIT WITH A REFLECTOR

The invention relates to a lighting unit provided with a concave reflector having an axis of symmetry and with a light emission window bounded by an edge of the reflector which surrounds the axis transversely thereto, an elongate light source which is axially arranged substantially on the axis of symmetry and which is accommodated in a holder opposite the light emission window, and an axially positioned cap serving as an optical screening means that partly surrounds the light source for intercepting unreflected light rays.

Such a lighting unit is known from EP 0336478. The light source is provided with an outer envelope. A cap impermeable to light is provided on the outer envelope at the side facing the light emission window. It is a problem to keep the opaque cap in place, because a direct connection between the cap and the outer envelope is exposed to major stresses owing to the large temperature differences that arise. This often leads to a failure of the connection in practice, so that the location of the relevant cap is no longer safeguarded. The problem identified above is aggravated if the light source is realized by means of a high-pressure discharge. A cap formed by a thin-walled metal bush, which is passed with clamping force over the outer envelope is also found to have no reliable positioning when exposed to the thermal stresses. Fastening of the cap to the reflector by means of radial fastening arms has the disadvantage that the fastening arms block out reflected light and thus interfere with the light beam formed by the reflector.

The invention has for its object to provide a solution to the above problem such that the above disadvantages are eliminated. According to the invention, the lighting source is for this purpose characterized in that the cap forms part of a sleeve surrounding the light source. A sleeve is often used as a protection means if there is a risk of a non-passive failure of the light source at end of life. It is especially a high-pressure discharge that involves a risk of a non-passive failure of the discharge vessel at end of life. The sleeve is preferably formed from a glass, which is at least resistant to a temperature of 600° C., such as hard glass, quartz glass, and quartz, and is fastened to the reflector at the area of the holder. The sleeve is provided with a coating impermeable to light at the area of the cap.

The fastening of the reflector at the area of the holder achieves that no light reflected by the reflector is blocked out. At the same time, the holder is at such a distance from the light source that thermal stresses are substantially reduced. This is even enhanced in a preferred embodiment in which the reflector is manufactured from metal, for example aluminum. Such a reflector promotes heat transport and accordingly temperature equalization.

In an advantageous embodiment of the lighting unit, the cap is surrounded at a distanced by a screening ring which is impermeable to light and which extends over a height h in the direction of the light emission window. A suitable shaping of the sleeve renders it possible to form the cap and the screening ring as an integrated body.

Unreflected emission of light originating from the portion of the light source located between the cup-shaped cap and the holder can be effectively prevented by the positioning of the screening ring impermeable to light, without this leading to a necessary increased dimension of the lighting unit in axial direction. If the screening ring extends parallel to the axis of symmetry, it is achieved at the same time that the screening ring causes no appreciable screening of the light emission window.

At the side facing the holder, the screening ring preferably extends up to a plane transverse to the axis of symmetry and defined by the cup-shaped cap. This prevents the screening ring itself from screening off the light source from the reflector. The height h of the screening ring is associated with the maximum value of an angle $\alpha$ viewed from the light emission window and bounded by the circumferential edge and the cup-shaped cap, within which angle the portion of the light source between the cap and the holder is visible without a screening ring. Preferably, the height h is chosen such that the screening ring completely cuts off the angle $\alpha$. The distance d of the screening ring to the cup-shaped cap is preferably chosen such that the screening ring extends up to the boundary of the angle $\alpha$ between the light source and the circumferential edge.

In an alternative embodiment, the screening ring forms part of a conical surface with a maximum apex angle of 10°. Given a conical shape with the apex angle at the side of the light emission window, the screening ring is advantageous for a reflector forming a converging beam. The screening ring in this case has a reduced surface area while the screening of the angle $\alpha$ remains the same. If the reflector forms a somewhat diverging beam, a screening ring forming part of a conical surface with an apex angle at the side of the holder is advantageous for reducing the interception of reflected light to a minimum.

The light source may be formed by an incandescent body, for example an incandescent coil, or by a discharge generated in a discharge vessel. Suitable preferred discharges are high-pressure sodium discharges and metal halide discharges. In either case, the discharge vessel is preferably formed from a ceramic material, this term denoting in the present description and claims sapphire, densely sintered polycrystalline metal oxide, for example aluminum oxide, and densely sintered polycrystalline aluminum nitride. Very compact light sources can be manufactured by means of such discharges because of their high efficacy, which light sources are highly suitable for realizing compact dimensions of the lighting unit according to the invention in combination with favorable beam properties. A metal halide light source has the favorable properties that very good color characteristics can be realized thereby and that it has a long operational life.

In a further advantageous embodiment, the holder is provided with an electrical connection contact for connecting an electrical supply source by means of a plug.

Preferably, the reflector and the light source are indetachably integrated into a lamp.

Figure 2A:
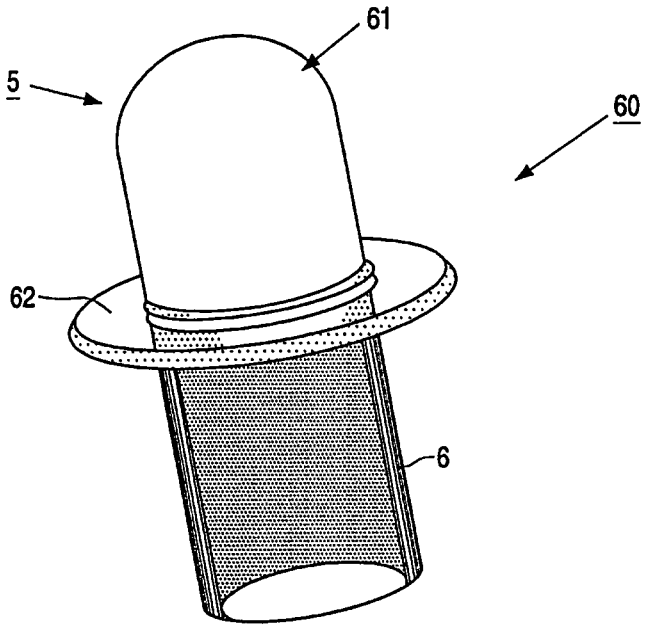
Figure 2B:
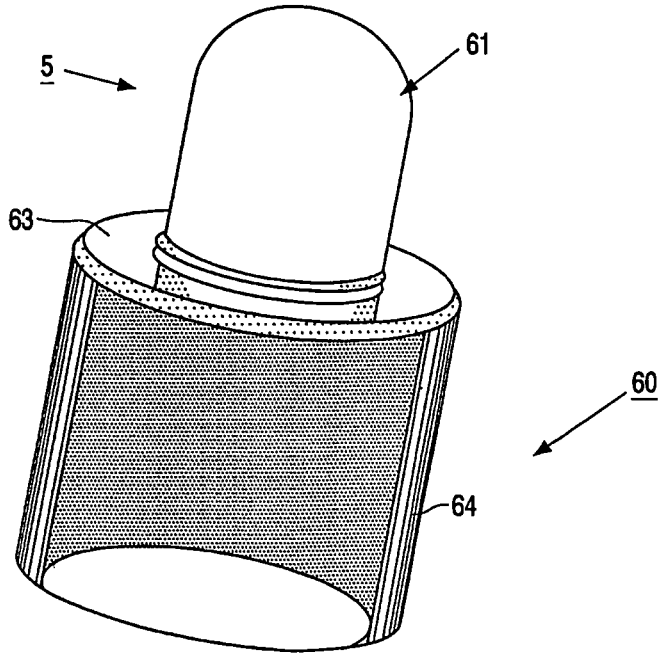
Figure 3:
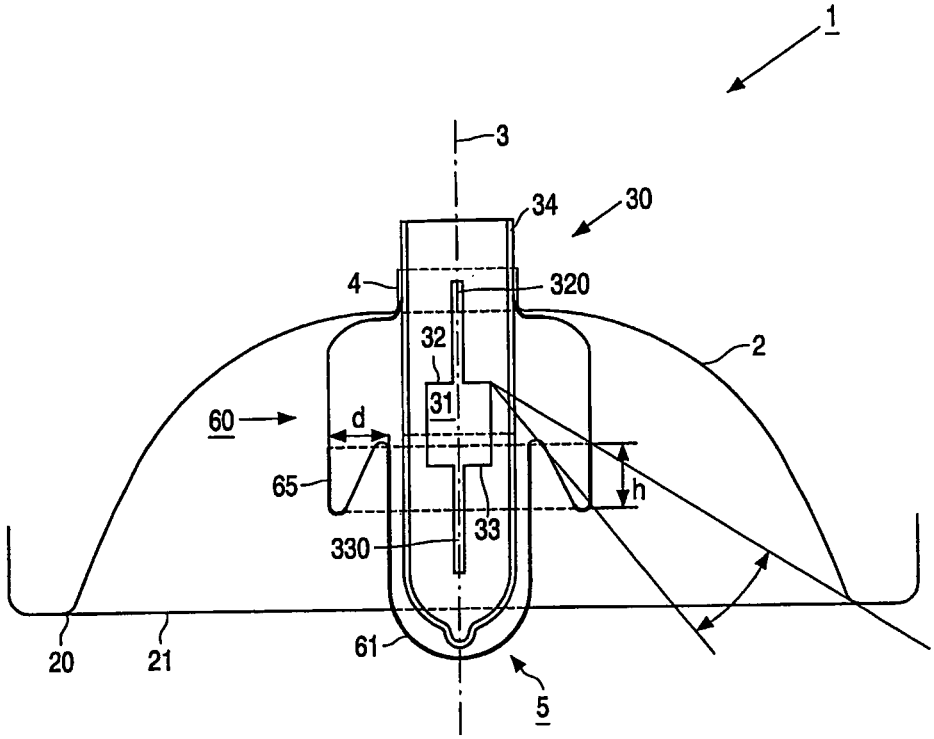

The above and further aspects of the invention will be explained in more detail with reference to a drawing, in which FIG. 1 is a cross-sectional view of a lighting unit according to the invention, FIGS. 2A and 2B are elevations of sleeves for use in the lighting unit of FIG. 1, and FIG. 3 shows an alternative embodiment of the lighting unit.

FIG. 1 shows a lighting unit 1 provided with a concave reflector 2 having an axis of symmetry 3 and a light emission window 21 bounded by a circumferential edge 20 of the reflector which is transverse to the axis, an elongate light source 30 which is axially positioned substantially on the axis of symmetry and which is accommodated in a holder 4 opposite the light emission window, an axially positioned cap 5 serving as an optical screening means which partly surrounds the light source so as to intercept unreflected light rays, said cap forming part of a sleeve 60 surrounding the light source.

In the embodiment shown, the light source is formed by a ceramic discharge vessel 31 provided with external closing plugs 320, 330 at axial end faces 32, 33 for positioning lead-through elements (not shown) to electrodes positioned in the discharge vessel, between which a discharge takes place in the operational state. This discharge is a metal halide discharge in the example described. The discharge vessel is held in an outer envelope 34 which is indetachably connected to the holder 4 in the case described. The reflector and the light source have thus been integrated into a metal halide lamp.

The sleeve 60 is a bell-shaped body 6 of hard glass on which an opaque coating 61 is provided at the area of the cap 5. The coating may be formed from materials, which are known per se, for example a metal such as aluminum or a solution of carbonyl iron and silicon. The coating may be provided in various ways, such as with a brush, by a printing technique, or by spraying, for example with an ink jet. The sleeve is also provided with an edge 64 which is impermeable to light.

FIGS. 2A and 2B are separate elevations of sleeves according to the invention. In FIG. 2A, the portion of the sleeve 60 forming the cap 5 is provided with an edge 62 which is transverse to the axis of symmetry and which is impermeable to light. Emission of light originating from that portion of the light source, which is situated between the cap and the holder is prevented thereby in a simple and effective manner. In the modification of FIG. 2B, the edge 63 is formed as a transition between the cap 5 and a sleeve portion 64 between the cap and the holder.

FIG. 3 shows a lighting unit whose sleeve 60 is shaped such that the cap 5 is surrounded at a distance d by an opaque screening ring 65 which extends over a height h in the direction of the light emission window. The cap 5 and the screening ring 65 are formed as one integrated body owing to a suitable design of the sleeve 60.

The invention claimed is:

1. A lighting unit comprising a concave reflector having an axis of symmetry a light emission window bounded by an edge of the reflector which surrounds the axis transversely thereto, an elongate light source which is axially arranged substantially on the axis of symmetry and which is accommodated in a holder opposite the light emission window, and an axially positioned cap serving as an optical screening means that partly surrounds the light source for intercepting unreflected light rays, the cap forming part of a sleeve surrounding the light source.

characterized in that the cap is surrounded at a distance d by a screening ring which is impermeable to light and which extends over a height h in the direction of the light emission window.

2. A lighting unit comprising a concave reflector defining an axis of symmetry and having an edge surrounding the axis, the edge being adapted to accommodate a light emission window at a position traverse to the axis;

an elongate light source arranged substantially along the axis;

an integral sleeve and cap unit formed into from a single piece of material and surrounding the light source, a cap portion of the sleeve and cap unit being at an end facing the position, the cap portion being adapted to act as an optical screening means that partly surrounds the light source and intercepts unreflected light rays, wherein the single piece of material also forms a screening ring around the axis, the screening ring enhancing the screening properties of the sleeve and cap unit.

3. The lighting unit of claim 2, wherein the single piece of material comprises a coating at the cap end for achieving the screening and intercepting properties of the cap.

4. The lighting unit of claim 2, wherein the sleeve and cap are formed from a single piece of material with a coating at the cap end for achieving the screening and intercepting properties of the cap.

5. A lighting unit comprising a concave reflector defining an axis of symmetry and having an edge surrounding the axis, the edge being adapted to accommodate a light emission window at a position traverse to the axis;

an elongate light source arranged substantially along the axis;

wherein an integral sleeve and cap unit formed into from a single piece of material and surrounding the light source, a cap portion of the sleeve and cap unit being at an end facing the position, the cap portion being adapted to act as an optical screening means that partly surrounds the light source and intercepts unreflected light rays;

the single piece of material also forms a screening ring around the axis, the screening ring enhancing the screening properties of the sleeve and cap unit;

the screening ring includes a boundary closer to the axis and an edge more distant from the axis, and a sleeve portion of the sleeve and cap unit extends from an edge of the screening ring which is more distant from the axis.

6. The lighting unit of claim 5, wherein the screening ring is at a perpendicular angle with respect to the axis.

7. The lighting unit of claim 5, wherein the screening ring is at a non-perpendicular angle with respect to the axis.

8. A lighting unit comprising a concave reflector defining an axis of symmetry and having an edge surrounding the axis, the edge being adapted to accommodate a light emission window at a position traverse to the axis;

an elongate light source arranged substantially along the axis;

an integral sleeve and cap unit formed into from a single piece of material and surrounding the light source, a cap portion of the sleeve and cap unit being at an end facing the position, the cap portion being adapted to act as an optical screening means that partly surrounds the light source and intercepts unreflected light rays, wherein the sleeve and cap unit comprises an integrally formed conical ring surface with a maximum apex angle of 10°, the apex angle being at the side of the position, a conical ring surface on the sleeve and cap unit defining a screening ring for forming a converging beam.

9. A method for manufacturing a lighting unit comprising integrally forming a sleeve and cap unit from a single piece of material, the cap portion of the sleeve and cap unit being for optically screening light rays and intercepting unreflected light rays;

assembling the sleeve and cap unit together with a reflector and light source, the reflector defining an axis of symmetry and having an edge adapted to hold a light emission window at a position traverse to the axis, the assembling being such that the light source is substantially along the axis and the sleeve and cap unit is around the light source with the cap facing the position, and forming a screening ring portion of the sleeve and cap unit from the same single piece of material, the screening ring also having optical screening and reflecting properties.

10. The method of claim 9, comprising coating the cap portion of the sleeve and cap unit to achieve the optical properties of the cap portion.

11. The method of claim 9, wherein the screening ring is at a non-perpendicular angle with respect to the axis.

12. The method of claim 9, wherein the screening ring is at a perpendicular angle with respect to the axis.

* * * * *